US009612002B2

(12) United States Patent
Allen et al.

(10) Patent No.: US 9,612,002 B2
(45) Date of Patent: Apr. 4, 2017

(54) LED LAMP WITH ND-GLASS BULB

(71) Applicant: GE Lighting Solutions, LLC, East Cleveland, OH (US)

(72) Inventors: Gary Robert Allen, Chesterland, OH (US); Dengke Cai, Mayfield Heights, OH (US); Thomas Clynne, East Cleveland, OH (US); David C. Dudik, Shaker Heights, OH (US); Jenna Marie Novak, East Cleveland, OH (US); Benjamin Lee Yoder, Cleveland Heights, OH (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 101 days.

(21) Appl. No.: 14/056,328

(22) Filed: Oct. 17, 2013

(65) Prior Publication Data

US 2015/0109758 A1 Apr. 23, 2015

Related U.S. Application Data

(60) Provisional application No. 61/715,824, filed on Oct. 18, 2012, provisional application No. 61/809,476, filed on Apr. 8, 2013.

(51) Int. Cl.
*F21V 9/00* (2015.01)
*F21V 29/00* (2015.01)
(Continued)

(52) U.S. Cl.
CPC ..... *F21V 13/08* (2013.01); *F21K 9/232* (2016.08); *F21K 9/233* (2016.08); *F21K 9/64* (2016.08);
(Continued)

(58) Field of Classification Search
CPC . F21K 9/135; F21K 9/137; F21K 9/56; F21V 13/08; F21V 29/02; F21V 3/02; F21V 3/0418; F21V 3/0463
See application file for complete search history.

(56) References Cited

U.S. PATENT DOCUMENTS 4,315,186 A * 2/1982 Hirano et al. ..... 313/111
5,548,491 A * 8/1996 Karpen ..... 362/510
(Continued)

FOREIGN PATENT DOCUMENTS

EP 2483596 A1 8/2012
KR 20120107071 A 9/2012
(Continued)

OTHER PUBLICATIONS

PCT Search Report and Written Opinion dated Nov. 9, 2013 from corresponding Application No. PCT/US2013/065609.

*Primary Examiner* — Peggy Neils
*Assistant Examiner* — Erin Kryukova
(74) *Attorney, Agent, or Firm* — GE Global Patent Operation; Peter T. DiMauro

(57) ABSTRACT

LED based lamps are disclosed. In an embodiment, an LED based lamp includes a concave optical diffuser, a concave neodymium-doped glass bulb, a reflector, a printed circuit board that includes a plurality of light-emitting diodes (LEDs) configured to emit light, and a heat sink body. The concave optical diffuser has a first interior volume, and the concave neodymium-doped glass bulb is positioned within the first interior volume. The neodymium-doped glass bulb defines a second interior volume, and both the reflector and the printed circuit board are positioned within the second interior volume. The reflector includes a sloped annular wall with an inner reflective surface and an outer reflective surface, and a bottom portion of the reflector is connected to
(Continued)

the printed circuit board. The heat sink is thermally connected to the printed circuit board and to the reflector.

11 Claims, 8 Drawing Sheets

(51) Int. Cl.

| | |
|---|---|
| ***F21V 9/16*** | (2006.01) |
| ***F21V 7/00*** | (2006.01) |
| ***F21V 3/00*** | (2015.01) |
| ***F21V 5/00*** | (2015.01) |
| ***F21V 13/08*** | (2006.01) |
| ***F21V 3/04*** | (2006.01) |
| ***F21V 3/02*** | (2006.01) |
| ***F21V 29/02*** | (2006.01) |
| ***F21V 29/70*** | (2015.01) |
| ***F21K 9/232*** | (2016.01) |
| ***F21K 9/233*** | (2016.01) |
| ***F21K 9/64*** | (2016.01) |

(52) U.S. Cl.
CPC ..... *F21V 3/02* (2013.01); *F21V 3/0418* (2013.01); *F21V 3/0463* (2013.01); *F21V 29/02* (2013.01); *F21V 29/70* (2015.01)

(56) References Cited

U.S. PATENT DOCUMENTS

| | | | | |
|---|---|---|---|---|
| 6,323,585 | B1 * | 11/2001 | Crane et al. | 313/112 |
| 6,890,085 | B2 | 5/2005 | Hacker | |
| 6,940,101 | B2 | 9/2005 | Yano et al. | |
| 7,105,989 | B2 | 9/2006 | Lamouri et al. | |
| 7,453,195 | B2 | 11/2008 | Radkov | |
| 7,537,356 | B2 | 5/2009 | Huang et al. | |
| 7,736,019 | B2 | 6/2010 | Shimada et al. | |
| 7,858,997 | B2 | 12/2010 | Yoshimura et al. | |
| 7,942,540 | B2 | 5/2011 | Harbers et al. | |
| 7,965,031 | B2 | 6/2011 | Brunner et al. | |
| 8,030,839 | B2 | 10/2011 | Hosokawa et al. | |
| 8,089,207 | B2 | 1/2012 | Ramer et al. | |
| 8,104,908 | B2 | 1/2012 | Harbers et al. | |
| 8,169,135 | B2 | 5/2012 | Zhai et al. | |
| 8,220,971 | B2 | 7/2012 | Harbers et al. | |
| 8,235,538 | B2 | 8/2012 | Wei et al. | |
| 8,247,959 | B2 | 8/2012 | Beers et al. | |
| 8,253,321 | B2 | 8/2012 | Naum et al. | |
| 8,253,336 | B2 | 8/2012 | Maxik et al. | |
| 8,322,896 | B2 * | 12/2012 | Falicoff et al. | 362/363 |
| 8,414,151 | B2 | 4/2013 | Allen et al. | |
| 8,604,684 | B2 * | 12/2013 | Pickard | 313/483 |
| 8,931,933 | B2 * | 1/2015 | Tong et al. | 362/373 |
| 2004/0212302 | A1 | 10/2004 | Letz et al. | |
| 2005/0175969 | A1 | 8/2005 | Hayes | |
| 2005/0253113 | A1 | 11/2005 | Letz et al. | |
| 2006/0071589 | A1 | 4/2006 | Radkov | |
| 2007/0241657 | A1 | 10/2007 | Radkov et al. | |
| 2008/0093615 | A1 * | 4/2008 | Lin et al. | 257/98 |
| 2010/0308356 | A1 | 12/2010 | Wirth | |
| 2010/0327306 | A1 | 12/2010 | Van Der Burgt et al. | |
| 2011/0058379 | A1 * | 3/2011 | Diamantidis | 362/296.01 |
| 2011/0080742 | A1 * | 4/2011 | Allen et al. | 362/294 |
| 2011/0084297 | A1 * | 4/2011 | Ogata et al. | 257/98 |
| 2011/0095686 | A1 | 4/2011 | Falicoff et al. | |
| 2011/0216523 | A1 * | 9/2011 | Tong et al. | 362/84 |
| 2011/0317283 | A1 | 12/2011 | Shim | |
| 2012/0043877 | A1 * | 2/2012 | Liang et al. | 313/113 |
| 2012/0049737 | A1 * | 3/2012 | Kitagawa | F21K 9/135 315/53 |
| 2012/0057327 | A1 | 3/2012 | Le et al. | |
| 2012/0134133 | A1 * | 5/2012 | Kang | 362/84 |
| 2012/0155059 | A1 * | 6/2012 | Hoelen et al. | 362/84 |
| 2012/0155061 | A1 | 6/2012 | Manabe et al. | |
| 2012/0223632 | A1 * | 9/2012 | Hussell et al. | 313/483 |
| 2012/0250304 | A1 | 10/2012 | Harbers et al. | |
| 2012/0300432 | A1 | 11/2012 | Matsubayashi et al. | |
| 2012/0307492 | A1 * | 12/2012 | Ariyoshi et al. | 362/235 |
| 2013/0114265 | A1 | 5/2013 | Sakumoto | |
| 2013/0170199 | A1 * | 7/2013 | Athalye et al. | 362/230 |
| 2014/0049191 | A1 * | 2/2014 | Maxik | H05B 33/086 315/307 |
| 2015/0146407 | A1 * | 5/2015 | Boonekamp et al. | 362/84 |

FOREIGN PATENT DOCUMENTS

| | | | |
|---|---|---|---|
| WO | 2009083867 | A1 | 7/2009 |
| WO | 2009107038 | A1 | 9/2009 |
| WO | 2010067817 | A1 | 6/2010 |
| WO | 2011035668 | A1 | 3/2011 |
| WO | 2011108203 | A1 | 9/2011 |
| WO | 2011109099 | A2 | 9/2011 |
| WO | 2012011460 | A1 | 1/2012 |
| WO | 2012080934 | A1 | 6/2012 |
| WO | 2013101537 | A1 | 7/2013 |

* cited by examiner

LED LAMP WITH ND-GLASS BULB

CROSS REFERENCE TO RELATED APPLICATION(S)

This patent application claims the benefit of U.S. Provisional Patent Application No. 61/715,824 filed on Oct. 18, 2012, and on U.S. Provisional Patent Application No. 61/809,476 filed on Apr. 8, 2013, the contents of which are hereby incorporated by reference for all purposes.

FIELD OF THE INVENTION

Embodiments of the present invention generally relate to lighting and lighting devices. In particular, the present disclosure relates to embodiments of a lighting apparatus using light-emitting diodes (LEDs), wherein the embodiments exhibit a spectral power distribution with enhanced red-green color contrast and enhanced overall color preference. In certain embodiments, lamps described herein may pertain to A-line lamps (e.g., A19-type) or BR lamps (e.g., BR30-type).

BACKGROUND OF THE INVENTION

Incandescent lamps (e.g., integral incandescent lamps and halogen lamps) mate with a lamp socket via a threaded base connector (sometimes referred to as an "Edison base" in the context of an incandescent light bulb). These lamps are often in the form of a unitary package, which includes components to operate from standard electrical power (e.g., 110 V and/or 220 V AC and/or 12 VDC). Such lamps find diverse applications such as in desk lamps, table lamps, decorative lamps, chandeliers, ceiling fixtures, and other general illumination applications. Several geometric shapes of incandescent lamps are used in such applications, including, but not limited to, A-line, R, BR, PAR, Decorative (Deco), and MR types of lamps.

Some types of incandescent lamps have an enhanced ability to render the red-green color contrast of illuminated objects. Such lamps have great appeal to users of lamps to illuminate objects, since they may cause the color of such objects to appear more rich or saturated. Especially appealing incandescent lamps of this type include the Reveal® brand of lamps which are sold by GE Lighting, an operating division of the General Electric Company. Customers of Reveal® products also prefer the "whiter" and "brighter" appearance of the light, and the enhanced overall color preference when compared to an unenhanced white spectrum.

Solid-state lighting technologies such as light-emitting diodes (LEDs) and LED-based devices often have superior performance when compared to incandescent lamps. This performance can be quantified by the useful lifetime of the lamp (e.g., its lumen maintenance and its reliability over time), lamp efficacy (lumens per watt), and other parameters.

It may be desirable to make and use an LED lighting apparatus also having appealing red-green color contrast properties.

SUMMARY OF THE INVENTION

Presented herein are LED based lamps. In an advantageous embodiment, an LED based lamp includes a concave optical diffuser, a separate concave neodymium-doped glass bulb, a reflector, a printed circuit board that includes a plurality of light-emitting diodes (LEDs) configured to emit light, and a heat sink body. The concave optical diffuser has a first interior volume, and the concave neodymium-doped glass bulb is positioned within the first interior volume. The neodymium-doped glass bulb defines a second interior volume, and both the reflector and the printed circuit board are positioned within the second interior volume. In some embodiments, the reflector includes a sloped annular wall with an inner reflective surface and an outer reflective surface, and a bottom portion of the reflector is connected to the printed circuit board. The heat sink is thermally connected to the printed circuit board and to the reflector.

In other beneficial embodiments, an LED based lamp is configured as a flood lamp, or BR-type lamp. In an implementation, an LED lamp includes an optical diffuser having a disc or concave disc shape, a heat sink body affixed to the optical diffuser, a reflector, a concave neodymium-doped glass bulb, and a printed circuit board comprising a plurality of LEDs. The heat sink body has a wall defining a first interior volume, and the reflector has a sloped annular reflective wall and is positioned within the first interior volume. The heat sink body has an interior surface defining a second interior volume, and the concave neodymium-doped glass bulb is positioned within the second interior volume. The printed circuit board is positioned at a lower portion of the reflector and is in thermal communication with the heat sink body. The plurality of LEDs on the printed circuit board is configured to emit light through the concave neodymium-doped glass bulb.

BRIEF DESCRIPTION OF THE DRAWINGS

Aspects and/or features of the invention and many of their attendant benefits and/or advantages will become more readily apparent and appreciated by reference to the detailed description when taken in conjunction with the accompanying drawings, which drawings may not be drawn to scale.

DETAILED DESCRIPTION

Figure 1:
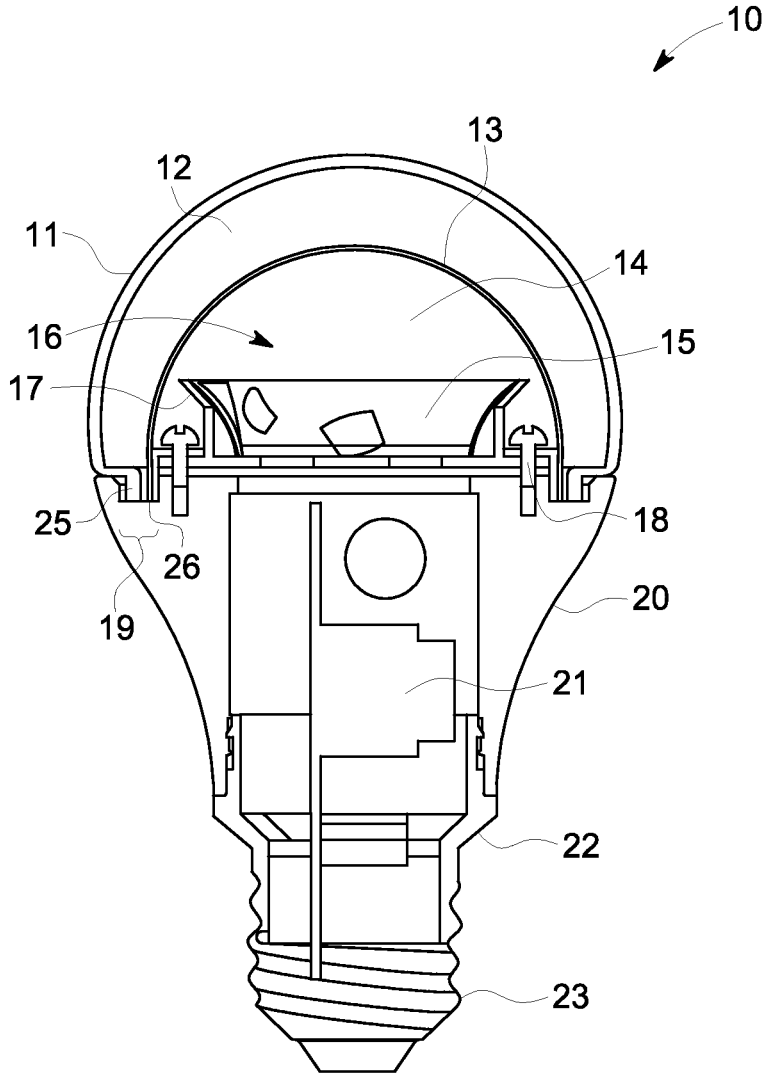
FIG. 1 is a schematic side-view depiction of exemplary lighting apparatus or lamp of the A-line type according to an embodiment of the invention.

In general, and for the purpose of introducing concepts of embodiments, described are LED-based lighting apparatus or lamps.

In some embodiments (for example, an A-line), the apparatus comprises an optical diffuser having a hemispheroidal, spheroidal, prolate or oblate ellipsoidal, ovoid, conical, polygonal-faced, or toroidal shape. The diffuser has a concave side defining a first interior volume. The apparatus further comprises a glass bulb having a hemispheroidal, spheroidal, prolate or oblate ellipsoidal, ovoid, conical, polygonal-faced, or toroidal shape, not necessarily the same shape as the optical diffuser, and doped with neodymium (Nd) oxide, $Nd_2O_3$, substantially nested within the first interior volume and generally separate from the optical diffuser. The bulb has a concave side which further defines a second interior volume. The apparatus includes a reflector, such as a truncated tapered reflector, i.e., generally having a shape of a truncated axisymmetric revolution of a conic section, and having an internal and external surface. In an implementation, the reflector has a sloped annular wall generally having a cross-section shape of a conic section. However, in some embodiments the sloped annular wall may be a straight wall or may be a curved wall. In some embodiments, the reflector also comprises a central transparent portion or central aperture defined by the interior of the reflector wall. The reflector is received substantially within the second interior volume.

In some embodiments, the lamp further comprises a plurality of LEDs mounted to a circuit board. The plurality of LEDs is configured to emit light generally axially upward, in a direction substantially perpendicular to the circuit board. Note that the apparatus is generally longitudinal, with a diffuser at an upper end and a base at a lower end. At least a first portion of the plurality of LEDs is configured to emit light through a central aperture of the reflector. In addition, at least a second portion of the plurality of LEDs is configured to emit light that reflects from a sloped annular reflective wall of the reflector.

The apparatus may further include a heat sink body which is in thermal communication with the circuit board, in order to dissipate the heat emanating from the plurality of LEDs when the apparatus is in operation. In the A-line embodiment, the heat sink body may include an annular groove at an upper portion thereof. The annular groove is sized and shaped to receive both a lip of the bulb and a lip of the diffuser therein.

The apparatus may further include a capper that has driver circuitry substantially enclosed within. The capper may be affixed to a lower portion of the heat sink. In some implementations, the apparatus includes a threaded base, to receive power from a socket.

In an A-line embodiment, the optical diffuser may be made of a glass or a polymeric material, e.g., a polycarbonate such as Teijin ML5206. The optical diffuser is usually capable of veiling light, such that light from individual LEDs is mixed and/or obscured. Generally, the diffuser distributes light and diffuses the light of individual LEDs. The optical diffuser may comprise a weakly diffusing low-optical-loss injection molded plastic bulk diffuser. In some embodiments, the optical diffuser generally has a white external appearance when the apparatus is not operation. The optical diffuser is generally separate from the neodymium-doped glass bulb and functions to diffuse light from the LEDs and to advantageously protect the neodymium-doped glass bulb from shattering or cracking from potentially damaging impacts that may occur (such as when or if the lamp is dropped onto a floor having a hard surface).

The glass bulbs in accordance with the embodiments disclosed herein may comprise a nominally soda lime glass, having impregnation with a neodymium compound such as neodymium oxide. The glass may comprise from about 2 wt % to about 15 wt % $Nd_2O_3$, for example, 6 wt %. $Nd_2O_3$. It is not preferred for the Nd2O3 to be impregnated into some polymer materials, in which the peak wavelength of the absorption may be shifted from that of the Nd-glass absorption which typically peaks at about 585 nm as shown in U.S. Published Patent Application No. 2007/0241657 A1, which is hereby incorporated by reference for all purposes. The peak wavelength and shape of the absorption spectrum depends on the material matrix into which the Nd2O3 is embedded, such that in some polymer embodiments, the peak absorption is so far away from the desired 585 nm, that the desired red-green enhancement is not obtained, or is not optimized. The glass bulb may also have an outer diameter of from about 50 to about 60 millimeters (mm) (for example, about 52 mm) and a wall thickness of from about 0.1 to about 2 mm (e.g., 0.5 mm). One function of the glass bulb is to absorb light from the LEDs when the apparatus is in operation, to induce a depression in a yellow portion of the visible light spectrum when light is transmitted therethrough. Of course, other types of glass or glass bulbs are possible, provided that such glass bulbs can modify a light source to induce a depression in a yellow portion of the visible light spectrum and increase red-green color contrast. In addition, other dimensions of the glass bulb are possible, as long as the glass bulb is in the optical path of some or all of the light emitted by the LEDs.

As aforementioned, in the A-line embodiment, the truncated conical reflector has a central aperture, and a first portion of the plurality of LEDs is configured to emit light rays axially through the central aperture. These light rays impinge directly onto the glass bulb and pass through to impinge on the optical diffuser. There is also a second portion of the plurality of LEDs which is arranged or configured to emit light so as to reflect from an external surface of the reflector, so as to distribute light in a radial direction and also in the direction of the base at the lower end of the apparatus. This combination of reflector and diffuser is effective to distribute light in a nearly omnidirectional manner. Generally, the reflector comprises a wider end and a narrow end, with the narrow end proximate the circuit board and with the wider end proximate the neodymium-doped glass bulb. A reflector in accordance with the several embodiments described herein may comprise a polymeric material and may be injection molded, although it may also be formed of metallic material in part or in whole. The external surface of the reflector may be a specular or a diffuse white, high reflectivity surface. Such a high reflectivity surface is usually achieved via highly reflective coatings and/or laminates.

FIG. 1 is a schematic side-view depiction of exemplary lighting apparatus or lamp 10 of the A-line type according to an embodiment. The lamp 10 includes an optical diffuser 11 defining a first interior space 12. Nested within interior space 12 is Nd-glass bulb 13, which defines a second interior space 14. A reflector 15 sits substantially within the second interior space 14. The reflector 15 comprises a central aperture 16 and a sloped side wall 17. Immediately below the reflector is the plurality of LEDs (not shown in this view) which may be mounted on a printed circuit board, such as a metal-core printed circuit board (MCPCB, not shown). In some embodiments, the reflector and/or circuit board are thermally connected to a heat sink body 20 by screws 18, while in other implementations the reflector and printed circuit board are otherwise affixed to the heat sink body, for example by a thermally conducting epoxy. An annular groove 19 is located on an upper portion of the heat sink body 20, and is sized and shaped to receive a diffuser lip 25 and a glass bulb lip 26. Cement or adhesive (not shown) may be used to affix the optical diffuser 11 and the glass bulb 13 to the annular groove 19. A capper 22 is shown that contains the driver electronics/circuitry 21. The lighting apparatus 10 is completed at its lower portion with a screw-threaded base 23. It should be understood that the lighting apparatus 10 also includes suitable wiring and additional components (not shown) to receive current at the driver circuitry 21 and to transmit a suitable current and voltage to drive the plurality of LEDs.

Figure 2:
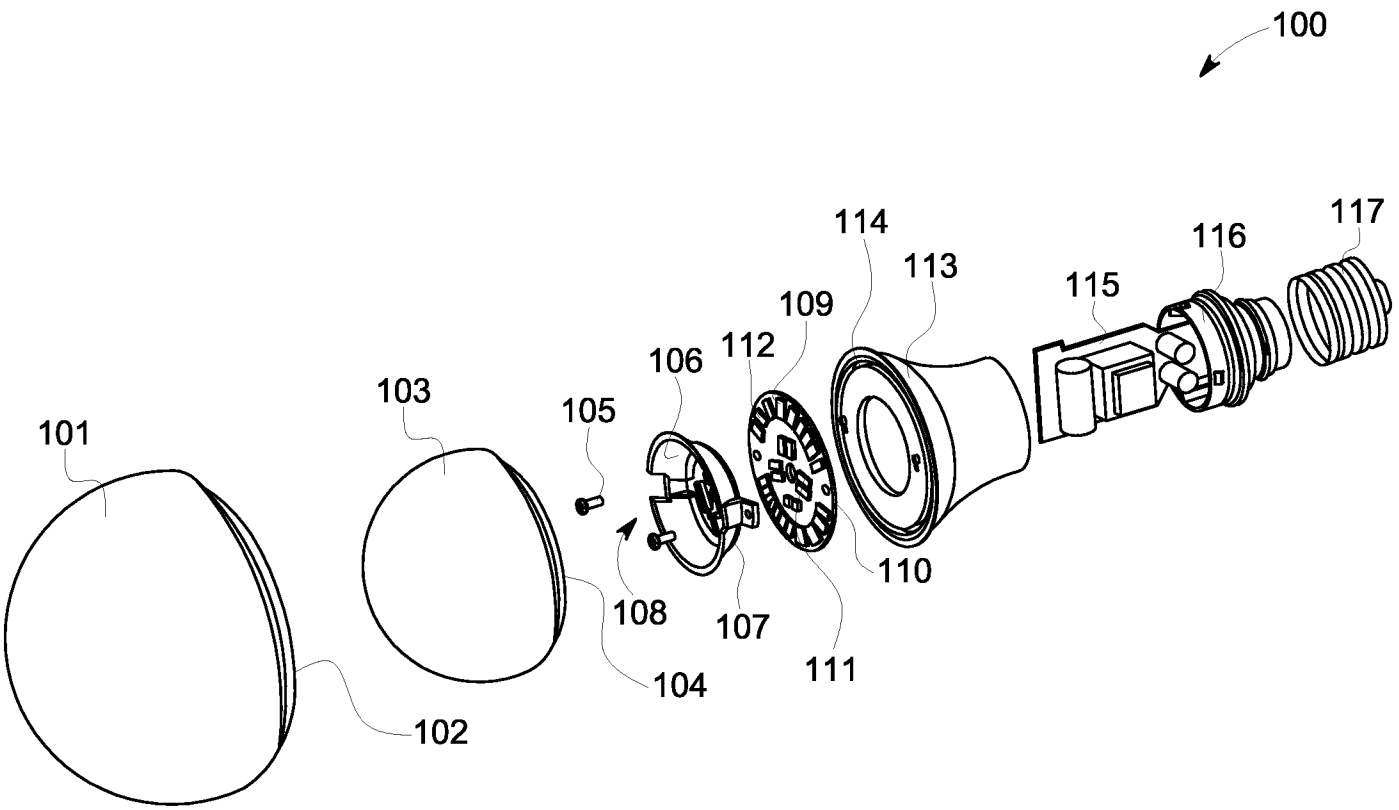
FIG. 2 is an exploded schematic perspective view of an exemplary lighting apparatus or lamp of the A-line type according to an embodiment of the invention.

FIG. 2 is an exploded schematic perspective view of an exemplary lighting apparatus or lamp 100 of the A-line type. The lamp 100 includes an optical diffuser 101 having a lip 102, and glass bulb 103 having a lip 104, both of which configured for seating in the annular groove 114 formed in an upper portion of the heat sink body 113. The apparatus 100 also includes a reflector 106 which has a bottom portion that is configured for attachment to the circuit board 110 and heat sink body 113 by screws 105. The central aperture 108 of the reflector 106, and the sloped wall 107 of the reflector 106, are also shown in this perspective view. The circuit board 110, which may be generally circle-shaped, includes a central array of LEDs 111 consisting of a plurality of LEDs located about a central portion thereof, and includes an annular array of LEDs 112 including a plurality of LEDs arrayed about an outside portion thereof. The combination of the central array of LEDs 111 and the annular array of LEDs 112 forms a light engine 109. The light engine 109 is configured for mounting in thermal communication with the heat sink body 113. Located at a lower portion of the lamp 100 is the capper 116, which is configured for housing the driver electronics 115 and for attachment to the base 117.

Figure 3:
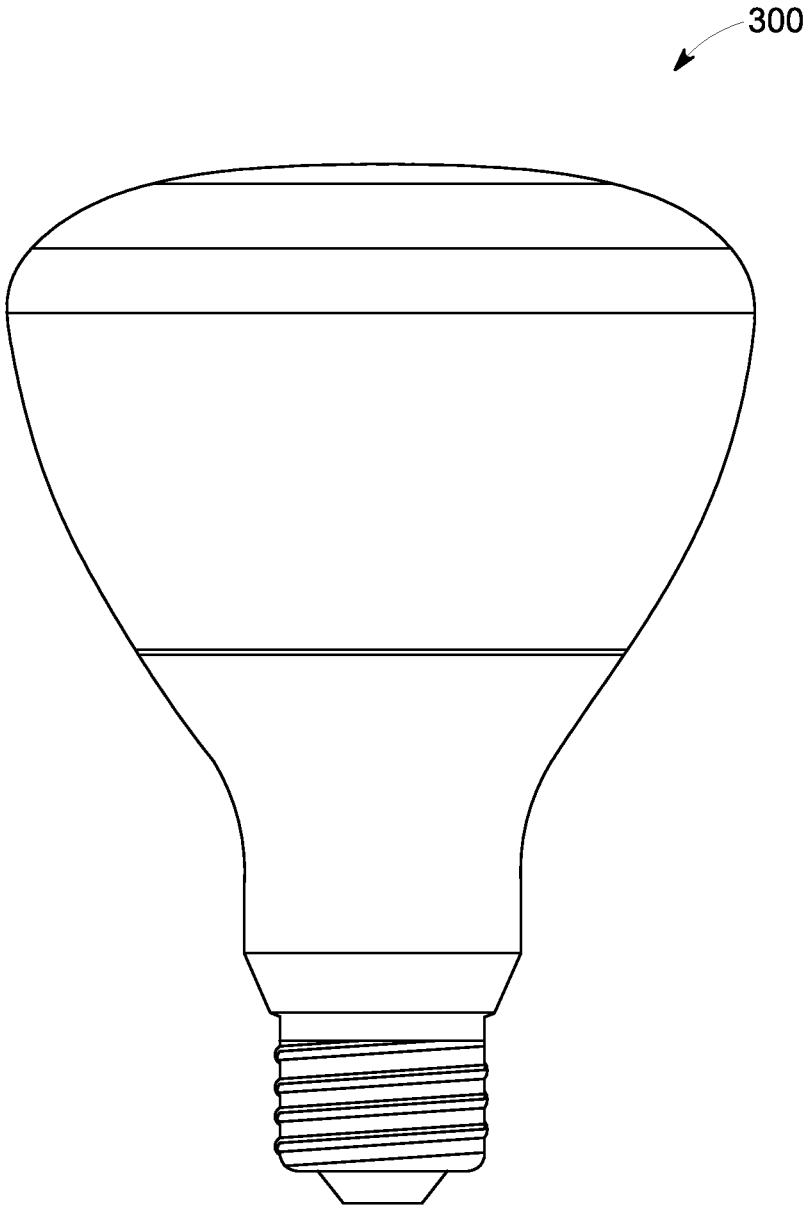
FIG. 3 illustrates an embodiment of a flood lamp incorporating components in accordance with an embodiment of the invention.

FIG. 3 illustrates a flood lamp 300 that incorporates the components described herein in accordance another embodiment, known as a BR-type lamp. Lamps with such a shape and form factor have generally been categorized by the American National Standards Institute (ANSI) as having part numbers BR20, BR30, BR40, and the like, with the difference between the various lamps being their largest diameter, expressed in one-eights (⅛'s) of an inch, so that, for example the BR20 lamp has a diameter of 20/8". These flood-lamp type lamps typically have a form factor incorporating a slight bulge in their base section and have been designated by ANSI with a "B" prefix to highlight this feature.

Figure 4:
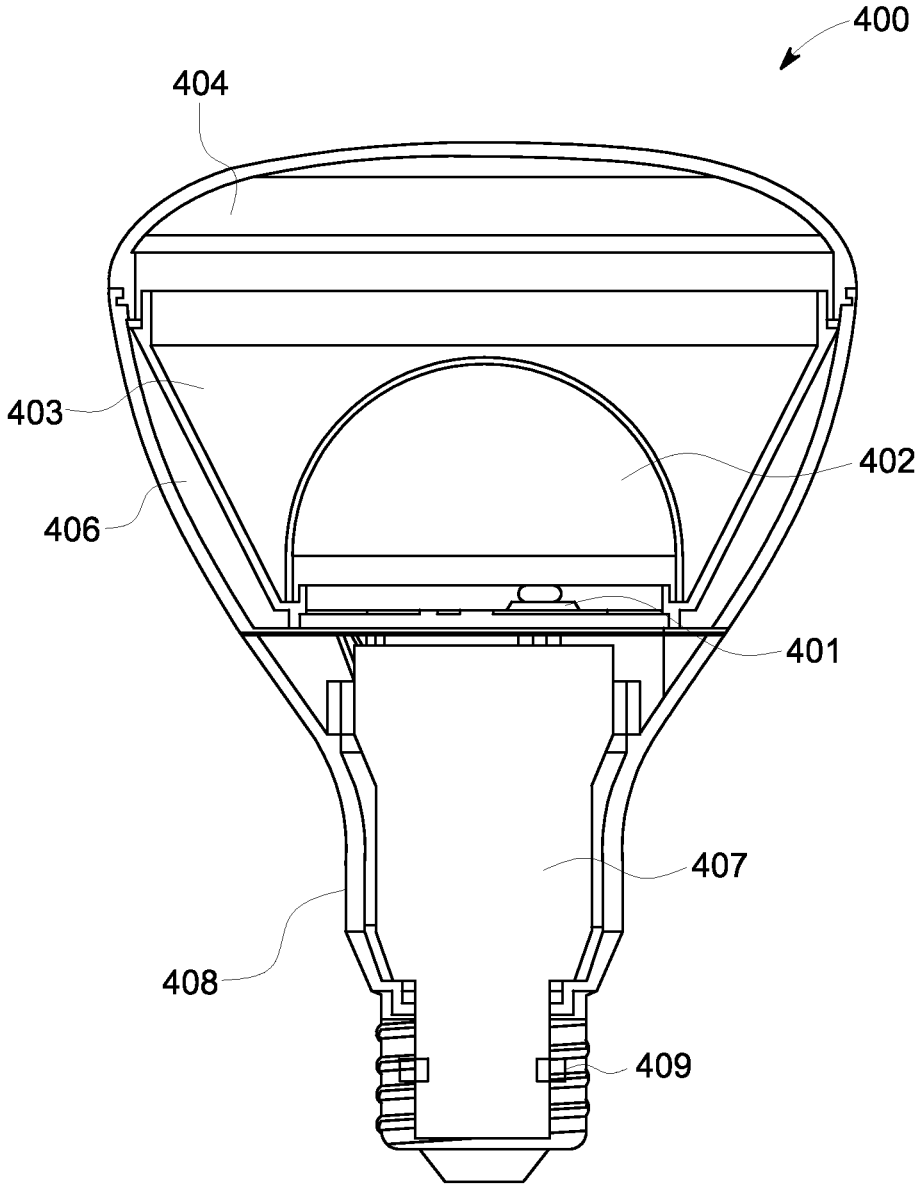
FIG. 4 is a cross-sectional view of the flood lamp of FIG. 3 in accordance with embodiments of the invention.
Figure 5:
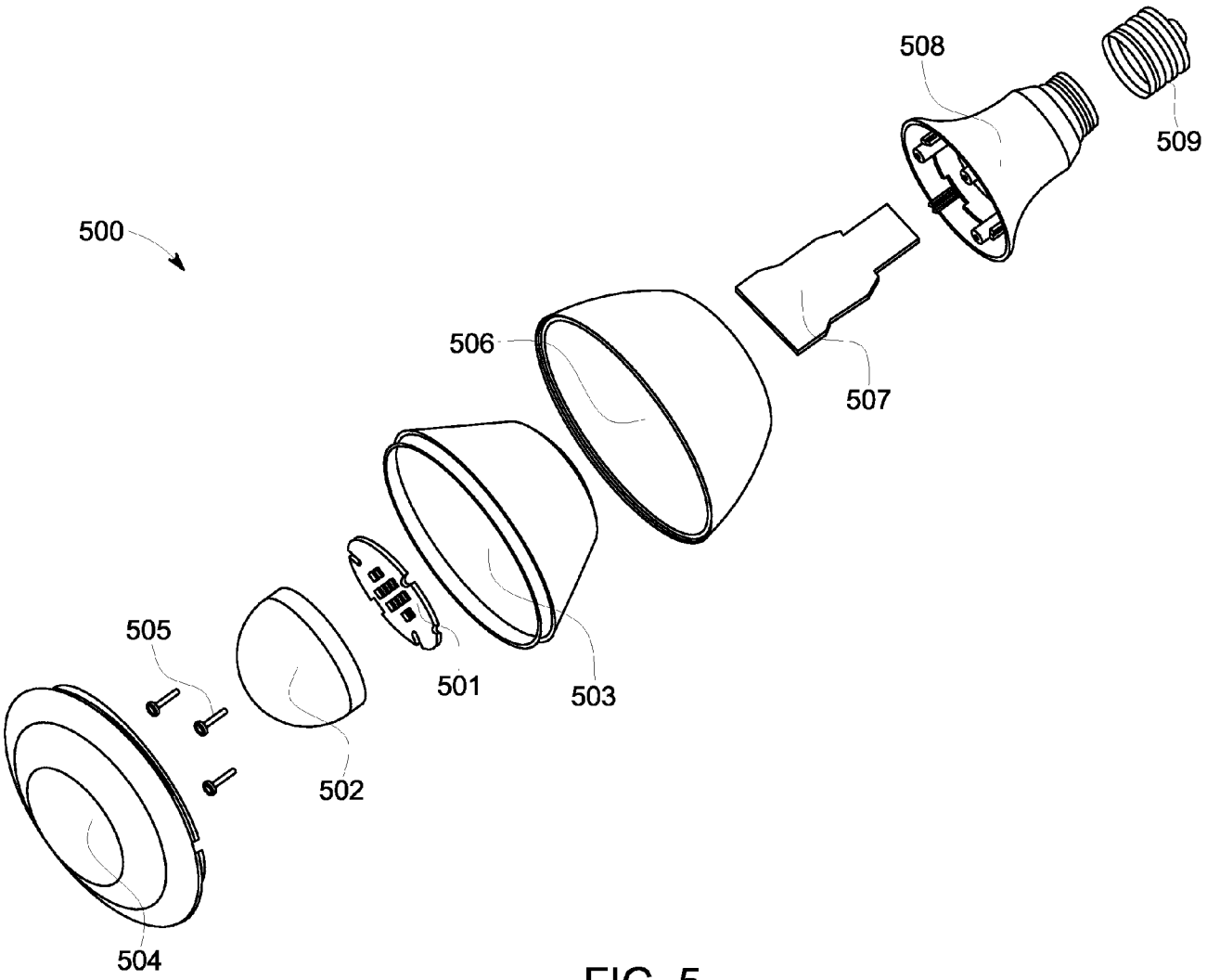
FIG. 5 is an exploded perspective view of the flood lamp of FIG. 4 in accordance with embodiments of the invention.

FIG. 4 is a cross-sectional view 400 of a BR30 type lamp, and FIG. 5 is an exploded perspective view 500 of the same BR30 type lamp, in accordance with some embodiments. The apparatus 400, 500 includes an optical diffuser 404, 504 having a convex meniscus or a disc shape having a curved edge. The diffuser 404, 504 thus has a concave side or flat inner side adjoining a first interior volume. In some embodiments, the optical diffuser may include a glass material, or a polymeric material, including many of the materials suitable for the optical diffuser discussed above with regard to the A-line embodiment. As above, the optical diffuser is capable of veiling light, such that light from individual LEDs is mixed and/or obscured. Note that the optical diffuser generally may have a white external appearance when the apparatus is not operation.

In some embodiments, a heat sink body 406, 506 may be mated or otherwise affixed to the optical diffuser 404, 504. As shown in FIGS. 4 and 5, the curved edge portion of the disc-shaped diffuser 404, 504 is configured to mate with an upper edge portion of the heat sink body 406, 506. An interior of the heat sink body 406, 506 defines a first interior volume. The heat sink body may be in thermal communication with a circuit board 401, 501 (described in more detail below), in order to dissipate heat emanating from a plurality of LEDs mounted thereon when the apparatus is in operation. A reflector 403, 503, having a shape that may be generally described by an axisymmetric revolution of a conic section (described more fully below) may be annularly received in the first interior volume. The heat sink body 406, 506 may be sized and shaped to receive and retain the reflector 403, 503 in its interior, as well as to impart the general BR-type appearance at its exterior.

In this example embodiment, the LED lamp 400, 500 may include a truncated reflector 403, 503 having a sloped annular reflective wall generally described by an axisymmetric revolution of a conic section, and a central aperture. The truncated reflector may generally have a shape of a truncated cone or parabola, or possibly a compound parabolic collector (CPC). This reflector may be received substantially within the first interior volume defined by the heat sink body 406, 506. An interior of the truncated reflector 403, 503 defines a second interior volume. The truncated reflector 403, 503 also may include a central transparent portion or central aperture on a forward end or top end thereof, to permit light emitted from a light engine (or light module including a plurality of LEDs) to impinge upon a Nd-doped glass dome 402, 502. The central aperture may be defined by the interior wall of the truncated reflector. In some embodiments, a reflector in accordance of this disclosure may be of a polymeric material and may be injection molded, but it could also be formed of a metallic material in part or in whole. In some implementations, the internal surface of the reflector 403, 503 comprises a diffusive high reflectivity surface. This diffusive high reflectivity surface may be achieved via highly reflective paints and/or laminates.

The LED based lighting apparatus 400, 500 may include a hemi-spheroidal-shaped neodymium-doped glass bulb 402, 502 nested substantially within the second interior volume defined by the truncated reflector 403, 503. In some embodiments, a ring (not shown) that surrounds the Nd-doped glass dome is utilized to affix the dome to the inside surface of the truncated diffuser.

As noted above, glass bulbs in accordance with some embodiments of this disclosure may include a nominally soda lime glass, having impregnation with a neodymium compound such as neodymium oxide. The same or similar proportions of Nd described hereinabove may be provided. Such glass bulbs may have a wall thickness of from about 0.1 mm to about 1 mm (for example, 0.5 mm). One function of the Nd-doped glass bulb is to absorb light from the LEDs when the apparatus is in operation, to induce a depression in a yellow portion of the visible light spectrum when light is transmitted therethrough, which provides enhanced red-green color contrast of illuminated objects as compared to conventional LED lamps. Such lamps thus hold great appeal to users for illuminating objects to cause the color of those objects to appear more rich or saturated. Descriptions of how Nd-doped glass bulbs may provide enhanced red-green color contrast can be found in U.S. Published Patent Application No. 2007/0241657, which has been incorporated by reference for all purposes herein.

Of course, other types of glass or glass bulbs are possible, provided they can modify a light source to induce a depression in a yellow portion of the visible light spectrum and increase red-green color contrast.

Referring again to FIGS. 4 and 5, the lamp 400, 500 of the BR embodiment may include a plurality of LEDs mounted to a circuit board 401, 501. The circuit board is usually located at a position proximate (or at) a lower portion of the truncated reflector 403, 503, and is in thermal communication with the heat sink body 406, 506. The plurality of LEDs may be configured to emit light generally axially, with at least a portion of the plurality of LEDs configured to emit light through the central aperture and thereon through the spheroidal neodymium-doped glass bulb 402, 502. The plurality of LEDs may also be configured to emit light that reflects from the sloped annular reflective wall of the truncated reflector 403, 503. In some embodiments, the plurality of LEDs is mounted to a circuit board in a substantially planar configuration, the circuit board may be connected to the heat sink body 506 and capper 508 via screws 505, and the circuit board may have a circular cross section. For example, in the BR30 embodiment, the plurality of LEDs may include 20 LEDs, wherein most or all of the LEDs reside in a central region of the circuit board. It should be understood, however, that other numbers and arrangements of LEDs are possible.

In the apparatus of the BR embodiment of FIGS. 4 and 5, a capper 408, 508 is configured to enclose driver circuitry and may be affixed to a lower portion of the heat sink body 406, 506. The capper 408, 508 encloses a drive board or driver electronics 407, 507 in its interior. The capper 408, 508 is affixed to a lower portion of the heat sink, and is also connected to a threaded base 409, 509, to receive power from an electrical socket.

The circuit board 401, 501 may be affixed to the heat sink body 406, 506 by a mechanical connection and/or by an adhesive, for example, by a thermally conductive adhesive. In some embodiments, the circuit board may comprise a substantially planar metal-core printed circuit board (MCPCB).

In some embodiments, the capper is sized and shaped to accept the driver circuitry or electronics for the lamp, while still permitting the apparatus to attain the aspect or profile conforming to the ANSI A19 or BR30 profile. Typically, the capper comprises a polymer, such as a thermoplastic engineering polymer, for example, PBT. Some embodiments utilize a base (23, 117, 409, 509), which may be a threaded Edison base. The lighting apparatus may be characterized as being configured with components that mate with a lamp socket via a threaded Edison base connector. The lighting apparatus may be further characterized as being an integral lamp constructed as a unitary package including all components required to operate from standard electrical power received at the base thereof.

Figure 6:
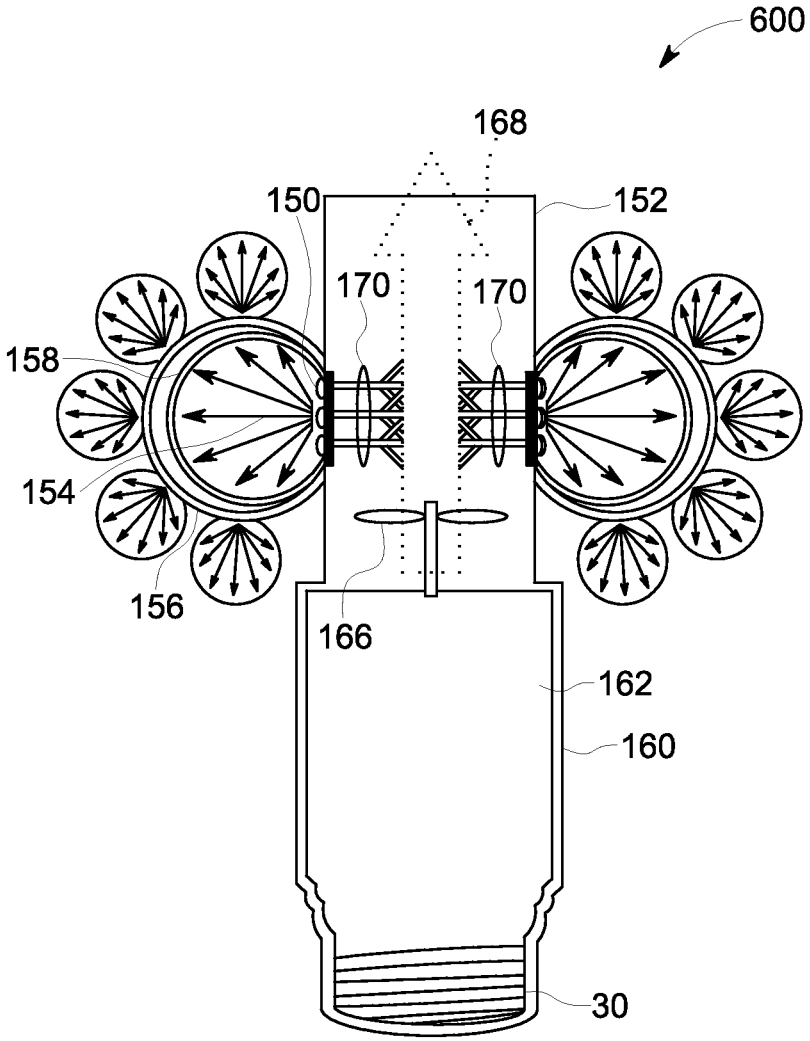
FIGS. 6 and 7A illustrate side and perspective side views, respectively, of a light source having a toroidal diffuser in accordance with embodiments of the invention.
Figure 7A:
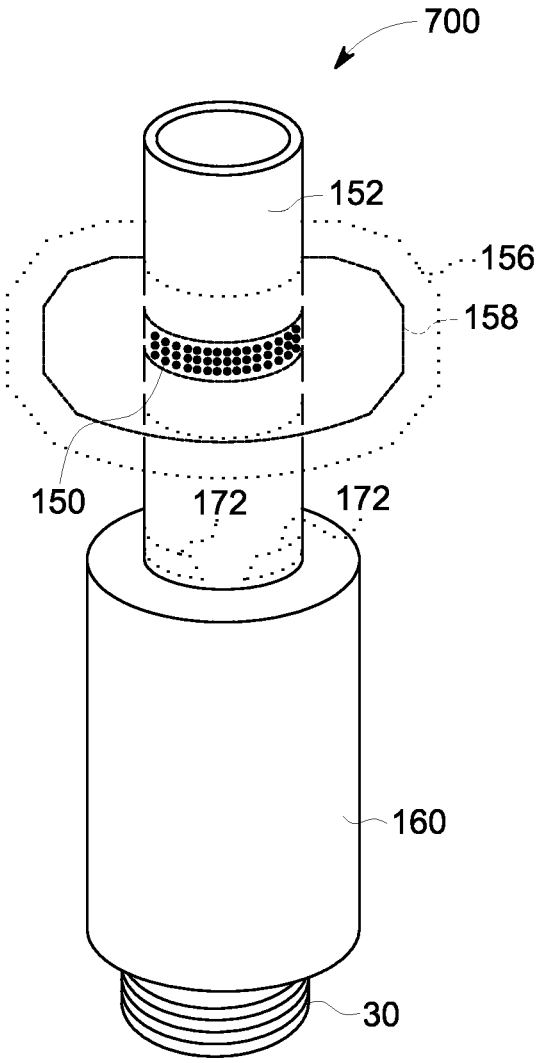
Figure 7B:
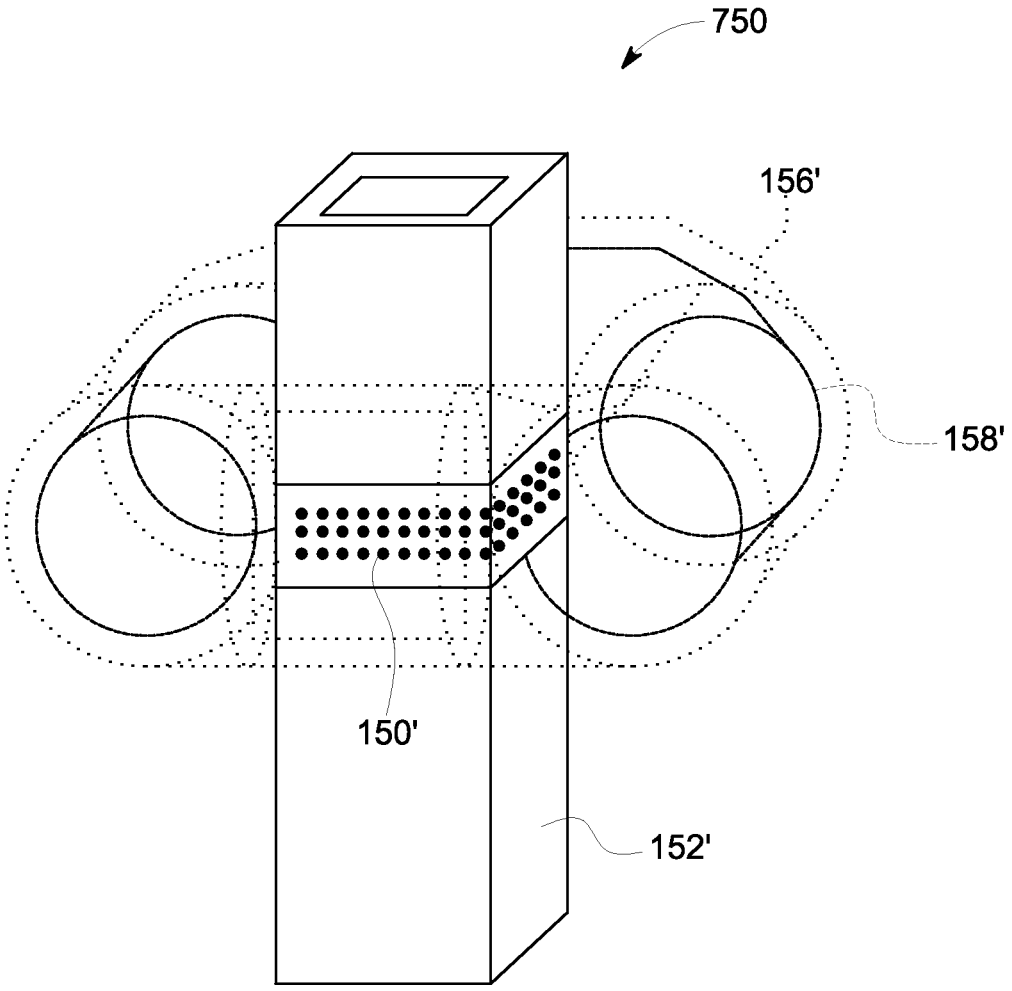
FIG. 7B depicts a variant embodiment of the light source of FIG. 7A in accordance with embodiments of the invention.

FIGS. 6 and 7A diagrammatically illustrate side 600 and perspective side views 700, respectively, of a light source employing principles disclosed herein with a toroidal diffuser. FIG. 7B depicts a variant embodiment 750.

With reference to FIGS. 6 and 7A, yet another embodiment is disclosed. This embodiment is an LED lamp suitable for replacing an incandescent light bulb and including the Edison base connector 30 facilitating use of the lamp as a retrofit incandescent bulb. A ring shaped LED-based light source 150 is arranged on a cylindrical former or chimney 152 so as to emit light outward from the cylindrical former or chimney 152. A toroidal diffuser 156 having a circular cross section (best seen in FIG. 6) is arranged to receive and scatter most of the illumination intensity 154. (Note that in FIG. 7A the toroidal diffuser 156 is diagrammatically shown in phantom in order to reveal LED based light source 150). A toroidal Nd glass filter 158 having a circular cross section is arranged to receive and filter most of the illumination intensity 154. However, the Nd glass filter 158 may be of another shape or geometry instead of toroidal in some embodiments.

The ring-shaped LED-based light source 150 is arranged tangential to the inside vertical surface of the toroidal diffuser 156 and emits its Lambertian illumination intensity 154 into the toroidal diffuser 156. The toroidal diffuser 156 preferably has a Lambertian-diffusing surface as diagrammatically illustrated in FIG. 6, so that at each point on the surface the incident illumination 154 is diffused to produce a Lambertian intensity output pattern emanating externally from that point on the surface of the toroidal diffuser 156. As a consequence, the lighting assembly comprising the ring-shaped LED-based light source 150 and the toroidal diffuser 156 of circular path cross-section generates light that is substantially omnidirectional both latitudinally and longitudinally.

The illustrated ring-shaped LED-based light source 150 is arranged tangential to the inside surface of the toroidal diffuser so that the illumination intensity pattern 154 is emitted most strongly in the horizontal, radial direction. In other embodiments, the ring-shaped LED-based light source 150 is arranged tangential to the bottom or top inside surface of the toroidal diffuser 156, or at any intermediate angular position along the inside surface of the toroidal diffuser 156.

In FIGS. 6 and 7A, the toroidal diffuser 156 has a circular cross-section for any point along its annular path, so that the toroidal diffuser 156 is a true torus. If the ring-shaped LED-based light source 150 has its Lambertian intensity pattern substantially distorted in a prolate or oblate fashion, then analogously the circular cross-section of the toroidal diffuser 156 is suitably correspondingly made prolate or oblate circular in order to coincide with an isolux surface. The toroidal Nd glass filter 158 may also suitably be correspondingly made prolate or oblate circular in order to coincide with the cross-section of the toroidal diffuser 156, or the it may be of any arbitrary concave geometry which is arranged to receive and filter most of the illumination intensity 154.

The illustrated chimney 152 of FIGS. 6 and 7A has a circular cross-section, and the ring-shaped light source 150 accordingly follows a circular path. With reference to FIG. 7B, in other embodiments, the chimney 152 has a polygonal cross-section, such as a triangular, square, hexagonal or octagonal cross section (not illustrated), in which case the ring-shaped light source suitably follows a corresponding polygonal (e.g., triangular, square, hexagonal or octagonal) path that is suitably made of three adjoined planar circuit boards (for triangular), four adjoined planar circuit boards (for square), six adjoined planar circuit boards (for hexagonal) or eight adjoined planar circuit boards (for octagonal) or more generally N adjoined planar circuit boards (for an N-sided polygonal chimney cross-section). For example, FIG. 7B shows a chimney 152' having a square cross-section, and a ring-shaped light source 150' following a square path that is made of four circuit boards adjoined at 90° angles to form a square ring conforming with the rectangular cross-section of the chimney 152'. A corresponding toroidal diffuser 156' (again shown diagrammatically in phantom to reveal light source 150') is also approximately four-sided, but includes rounded transitions between adjoining sides of the four-sided toroid to facilitate manufacturing and smooth light output. The toroidal Nd glass filter 158' may also suitably be correspondingly made in order to coincide with the cross-section of the toroidal diffuser 156', or it may be of any arbitrary concave geometry which is arranged to receive and filter most of the illumination intensity from the ring-shaped light source 150'.

With returning reference to FIGS. 6 and 7A, the lamp includes a base 160 that includes or supports the chimney 152 at one end and the Edison base connector 30 at the opposite end. As shown in the sectional view of FIG. 6, the base 160 contains electronics 162 including electronics for energizing the ring-shaped LED-based light source 150 to emit the illumination 154. As further shown in the sectional view of FIG. 6, the chimney 152 is hollow and contains a heat sink embodied as a coolant circulating fan 166 disposed inside the chimney 152. The electronics 162 also drive the coolant circulating fan 166. The fan 166 drives circulating air 168 through the chimney 152 and hence in close proximity to the ring-shaped LED-based light source 150 to cool the ring-shaped light source 150. Optionally, heat-dissipating elements 170 such as fins, pins, or so forth, extend from the ring-shaped LED-based light source 150 into the interior of the hollow chimney 152 to further facilitate the active cooling of the light source. Optionally, the chimney includes air inlets 172 (see FIG. 7A) to facilitate the flow of circulating air 168.

The active heat sinking provided by the coolant fan 166 can optionally be replaced by passive cooling, for example by making the chimney of metal or another thermally conductive material, and optionally adding fins, pins, slots or other features to increase its surface area. In other contemplated embodiments, the chimney is replaced by a similarly sized heat pipe having a "cool" end disposed in a metal slug contained in the base 160. Conversely, in the embodiments of FIGS. 5 and 6 and elsewhere, the depicted passive heat sinking is optionally replaced by active heat sinking using a fan or so forth. Again, it is contemplated for the base heat sink element in these embodiments to be an active heat sink element such as a cooling fan, or another type of heat sink element such as a heat pipe.

The lamp depicted in FIGS. 6 and 7A is a unitary LED replacement lamp installable in a lighting socket (not shown) by connecting the base connector 30 with the lighting socket. The unitary LED replacement lamp of FIGS. 6 and 7A is a self-contained omnidirectional LED replacement lamp that does not rely on the socket for heat sinking, and can be driven by 110V or 220V A.C., or 12V or 24V or other voltage D.C. supplied from a lamp socket via the Edison base connector 30.

The LED replacement lamp of FIGS. 6 and 7A (with optional modifications such as that illustrated in FIG. 7B) is particularly well-suited for retrofitting higher-wattage incandescent bulbs, such as incandescent bulbs in the 60 W to 100 W or higher range. Operation of the active cooling fan 166 is expected to use about one to a few watts or less, which is negligible for these higher-wattage lamps, while the active heat sinking is capable of heat transfer and dissipation at levels of tens of watts so as to enable use of high-power LED devices operating with driving currents in the ampere to several ampere range. The cooling of the lamp of FIGS. 6 and 7A does not rely predominantly upon conduction of heat into the lamp socket via the Edison base connector 30, and so the LED replacement lamp of FIGS. 6 and 7A can be used in any standard threaded light socket without concern about thermal loading of the socket or adjacent hardware. The toroidal arrangement of the light assembly also facilitates using a higher number of LEDs by spreading the LEDs out along the ring-shaped path of the ring-shaped light source 150.

In the several embodiments described herein, each of the plurality of LEDs may have a correlated color temperature of 2500 K-4000 K, for example, about 2700 K or about 3000 K. Furthermore, in some embodiments, each of the plurality of LEDs may have a color point substantially on the Planckian locus of the CIE diagram, so that the downward shift of the color point due to the Nd absorption does not result in the color point of the lamp being excessively far below the Planckian locus. In some implementations, each of the plurality of LEDs may have a color point substantially above the Planckian locus of the CIE diagram. Furthermore, in some embodiments, each of the plurality of LEDs has a CRI value of about 70 to about 97, for example, about 80, or about 90. For example, each of the plurality of LEDs may be a warm-white phosphor-converted LED, such as may be obtained from the Seoul Semiconductor Company as Model 5630, or from the Nichia Company as Model 757. In the embodiments described herein, each of the plurality of LEDs may be a package comprising a blue- or blue-violet emitting diode converted with a YAG:Ce phosphor, optionally with a red phosphor such as a Nitride Red phosphor.

In aspects described herein, the lighting apparatus as a whole substantially may conform to the ANSI A19 or BR30 profile. The lighting apparatus may be configured to be employed as a replacement lamp for 60 W incandescent lamps substantially conforming to the ANSI A19 profile, or for 65 W incandescent lamps substantially conforming to the ANSI BR30 profile. Of course, due to the efficiency of LEDs, such "60 W" or "65 W" replacement lamps may, in operation, be configured to operate between 5-25 Watts (W), for example, from 10 W to 20 W, or for example about 15 W.

In operation, the lighting apparatus in the embodiments of this disclosure is further characterized as having an attenuation, trough, or depression, in the spectrum of its emitted light in the region between about 565 nanometers (nm) to about 620 nm. That is, the spectrum of the emitted light may have a depression in its spectrum of emitted light in that region, as compared to the same lighting apparatus without the Nd-doped glass bulb. This region may be more narrowly defined as being between about 565 nm to about 595 nm, and in some implementations may be between about 575 nm and 590 nm. Furthermore, the lighting apparatus, in operation, may exhibit an attenuation, trough, or depression in the spectrum of its emitted light in the region between about 565 nm to about 620 nm of about 40% to about 80% (e.g., 50%), as compared to the same lighting apparatus without the Nd-doped glass bulb.

A lighting apparatus in accordance with the several embodiments disclosed herein may provide an enhanced red-green color contrast, enhanced overall color preference, and brighter, whiter appearance to illuminated objects. Furthermore, the lighting apparatus in accordance with the several embodiments may, in operation, emit light of correlated color temperature of about 2700 Kelvin (K) or about 3000 K with a color point below the Planckian locus of the CIE diagram. In addition, the lighting apparatus in accordance with disclosed embodiments may, in operation, emit light with a change in CCY value relative to the Planckian locus (DCCY) of about −0.005 to about −0.040, e.g., −0.01.

The above description and/or the accompanying drawing is not meant to imply a fixed order or sequence of steps for any process referred to herein; rather any process may be performed in any order that is practicable, including but not limited to simultaneous performance of steps indicated as sequential.

Although the present invention has been described in connection with specific exemplary embodiments, it should be understood that various changes, substitutions, and alterations apparent to those skilled in the art can be made to the disclosed embodiments without departing from the spirit and scope of the invention as set forth in the appended claims.

What is claimed is:

1. A LED based lamp, comprising:

a concave optical diffuser having a first interior volume and comprising a circular diffuser lip;

a concave neodymium-doped glass bulb positioned within the first interior volume and being separate from the concave optical diffuser, the glass bulb having a second interior volume and comprising a circular glass bulb lip;

a reflector positioned within the second interior volume;

a printed circuit board comprising a plurality of light-emitting diodes (LEDs) configured to emit light, the printed circuit board attached to a bottom portion of the reflector within the second interior volume such that the concave neodymium-doped glass bulb absorbs light when the LEDs are illuminated to induce a depression in a yellow portion of the visible light spectrum; and a heat sink thermally connected to the printed circuit board and to the reflector, wherein the heat sink comprises an annular groove formed in an upper portion that is sized and shaped to seat the entirety of both the circular diffuser lip and the circular glass bulb lip.

2. The LED based lamp of claim 1, further comprising a capper connected to the heat sink and housing driver circuitry.

3. The LED based lamp of claim 2, further comprising a base connected to the capper.

4. The LED based lamp of claim 1, wherein the reflector comprises a sloped annular wall with an inner reflective surface and an outer reflective surface, the sloped annular wall defining a central aperture, and wherein the plurality of LEDs comprises a central LED array positioned about a central portion of a surface of the printed circuit board and an annular LED array positioned about an outside portion of the surface of the printed circuit board, wherein the central LED array emits light through the central aperture of the reflector and the annular LED array emits light that reflects from the outer reflective surface of the sloped annular wall to distribute light in a radial direction.

5. The LED based lamp of claim 1, wherein the reflector and the printed circuit board are affixed to the heat sink body by screws.

6. The LED based lamp of claim 1, wherein the optical diffuser has at least one of an ovoid shape, a hemispheroidal shape, or a spheroidal shape.

7. The LED based lamp of claim 1, wherein the neodymium-doped glass bulb has a wall thickness of from about 0.1 mm to about 1.

8. The LED based lamp of claim 1, wherein the depression in the yellow portion of the visible light spectrum of is in the region between about 565 nanometers (nm) to about 620 nm.

9. The LED based lamp of claim 1, wherein the depression in the yellow portion of the visible light spectrum is in the region between about 565 nm to about 595 nm.

10. The LED based lamp of claim 1, wherein the plurality of LEDs has a correlated color temperature of from about 2500 Kelvin (K) to about 4000 K.

11. The LED based lamp of claim 1, wherein the plurality of LEDs has a CRI value of about 70 to about 97.

* * * * *